US009471024B1

(12) United States Patent
Nakata

(10) Patent No.: US 9,471,024 B1
(45) Date of Patent: Oct. 18, 2016

(54) IMAGE READING DEVICE AND IMAGE FORMING APPARATUS

(71) Applicant: FUJI XEROX CO., LTD., Tokyo (JP)

(72) Inventor: Ryusuke Nakata, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/831,335

(22) Filed: Aug. 20, 2015

(30) Foreign Application Priority Data

Mar. 25, 2015 (JP) ..... 2015-063389

(51) Int. Cl.
*G03G 15/00* (2006.01)
*B65H 9/00* (2006.01)

(52) U.S. Cl.
CPC ..... *G03G 15/6561* (2013.01); *B65H 9/004* (2013.01); *B65H 2301/331* (2013.01); *B65H 2801/03* (2013.01)

(58) Field of Classification Search
CPC ..... G03G 15/6561
USPC ..... 399/395
See application file for complete search history.

(56) References Cited

U.S. PATENT DOCUMENTS 5,662,321 A * 9/1997 Borostyan ..... B65H 7/08 271/10.03
2002/0030321 A1* 3/2002 Sugiyama ..... B65H 9/006 271/226
2004/0212139 A1* 10/2004 Nagao ..... B65H 1/08 271/110
2004/0240916 A1* 12/2004 Takata ..... G03G 15/602 399/367
2008/0112021 A1* 5/2008 Katsuyama ..... H04N 1/00342 358/498
2008/0309989 A1* 12/2008 Shirai ..... B65H 7/06 358/474

FOREIGN PATENT DOCUMENTS

JP 2005-263396 A 9/2005
JP 2008-050132 A 3/2008

* cited by examiner

*Primary Examiner* — Anthony Nguyen
(74) *Attorney, Agent, or Firm* — Oliff PLC

(57) ABSTRACT

An image reading device includes a document container; a document transport path; a reading member that reads an image of a document passing a predetermined read position; a skew correcting member that corrects a skew of the document; a first detecting member that detects the document; a second detecting member that detects the document; a correction switcher that performs switching in accordance with whether or not skew correction is to be executed at the skew correcting member; a skew-amount measurer that measures a skew amount of the document based on a first time period if the skew of the document is to be corrected, and that measures the skew amount based on a second time period if the skew of the document is not to be corrected; and a transport stopping unit that stops transporting of the document if the skew amount exceeds a predetermined skew amount.

6 Claims, 7 Drawing Sheets

$$\tan\theta 1 = \frac{sk1}{400} = \frac{V1 \cdot t2' - L1'}{L2}$$

$$sk1 = (V1 \cdot t2' - L1') \cdot (400/L2)$$

IMAGE READING DEVICE AND IMAGE FORMING APPARATUS

CROSS-REFERENCE TO RELATED APPLICATIONS

This application is based on and claims priority under 35 USC 119 from Japanese Patent Application No. 2015-063389 filed Mar. 25, 2015.

BACKGROUND

Technical Field

The present invention relates to image reading devices and image forming apparatuses.

SUMMARY

According to an aspect of the invention, there is provided an image reading device including a container that accommodates a document; a transport path along which the document from the container is transported; a reading member that reads an image of the document passing a predetermined read position in the transport path; a skew correcting member that is disposed upstream of the read position in a transport direction of the document, transports the document downstream, and corrects a skew of the document when the document is brought into abutment with the skew correcting member; a first detecting member that is disposed upstream of the skew correcting member and downstream of the container in the transport direction of the document and that detects the document; a second detecting member that is disposed downstream of the skew correcting member and upstream of the read position in the transport direction of the document and that detects the document; a correction switcher that performs switching in accordance with whether or not skew correction is to be executed at the skew correcting member; a skew-amount measurer that measures a skew amount of the document based on a time period from when the skew correcting member starts to rotate to when the second detecting member detects the document if the skew of the document is to be corrected, and that measures the skew amount of the document based on a time period from when the first detecting member detects the document to when the second detecting member detects the document if the skew of the document is not to be corrected; and a transport stopping unit that stops transporting of the document if the skew amount of the document exceeds a predetermined skew amount.

BRIEF DESCRIPTION OF THE DRAWINGS

An exemplary embodiment of the present invention will be described in detail based on the following figures, wherein.

DETAILED DESCRIPTION

Figure 1:
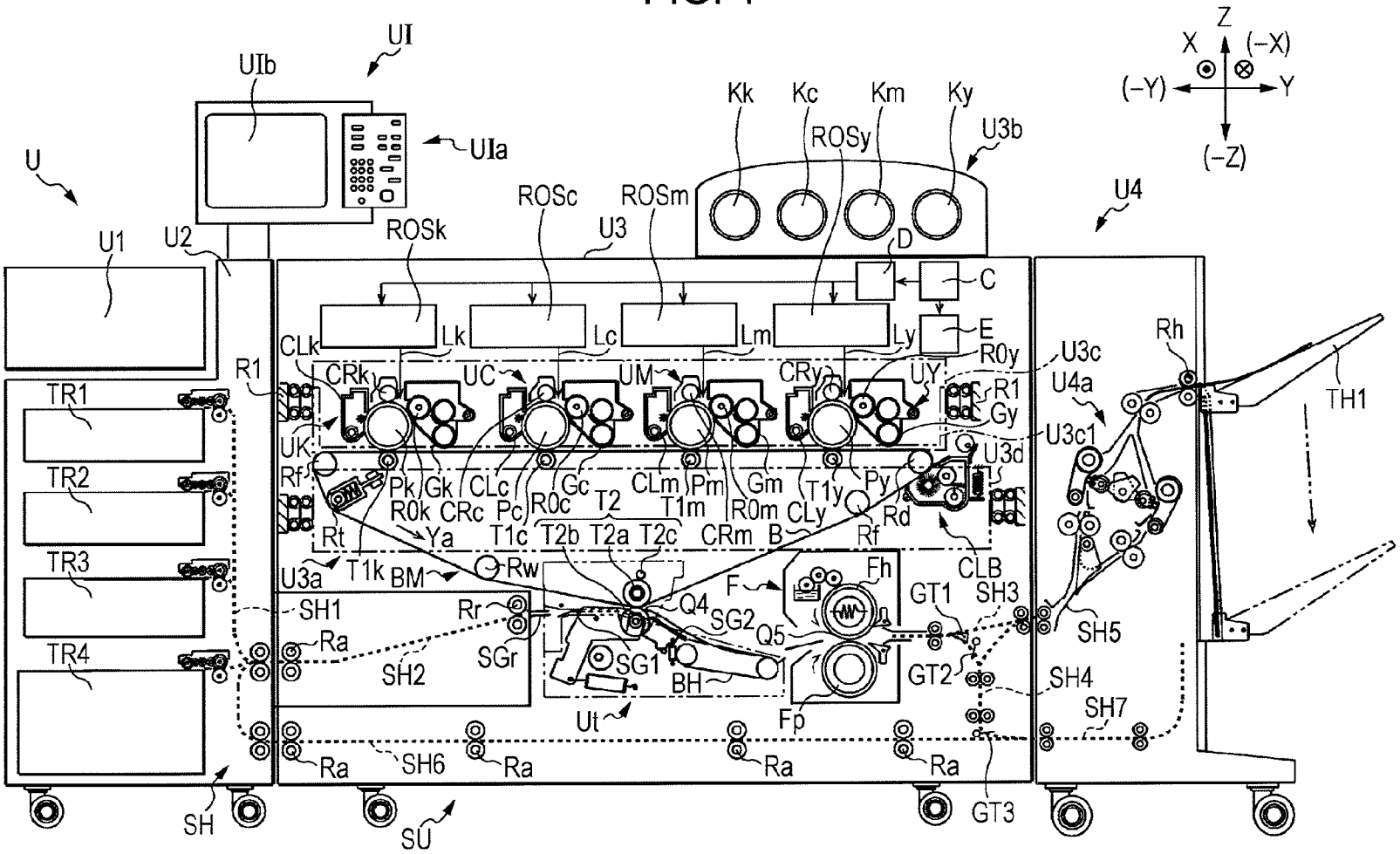
FIG. 1 is an overall view of an image forming apparatus according to a first exemplary embodiment.

Although a specific exemplary embodiment of the present invention will be described below with reference to the drawings, the present invention is not to be limited to the following exemplary embodiment.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 is an overall view of an image forming apparatus according to a first exemplary embodiment.

Figure 2:
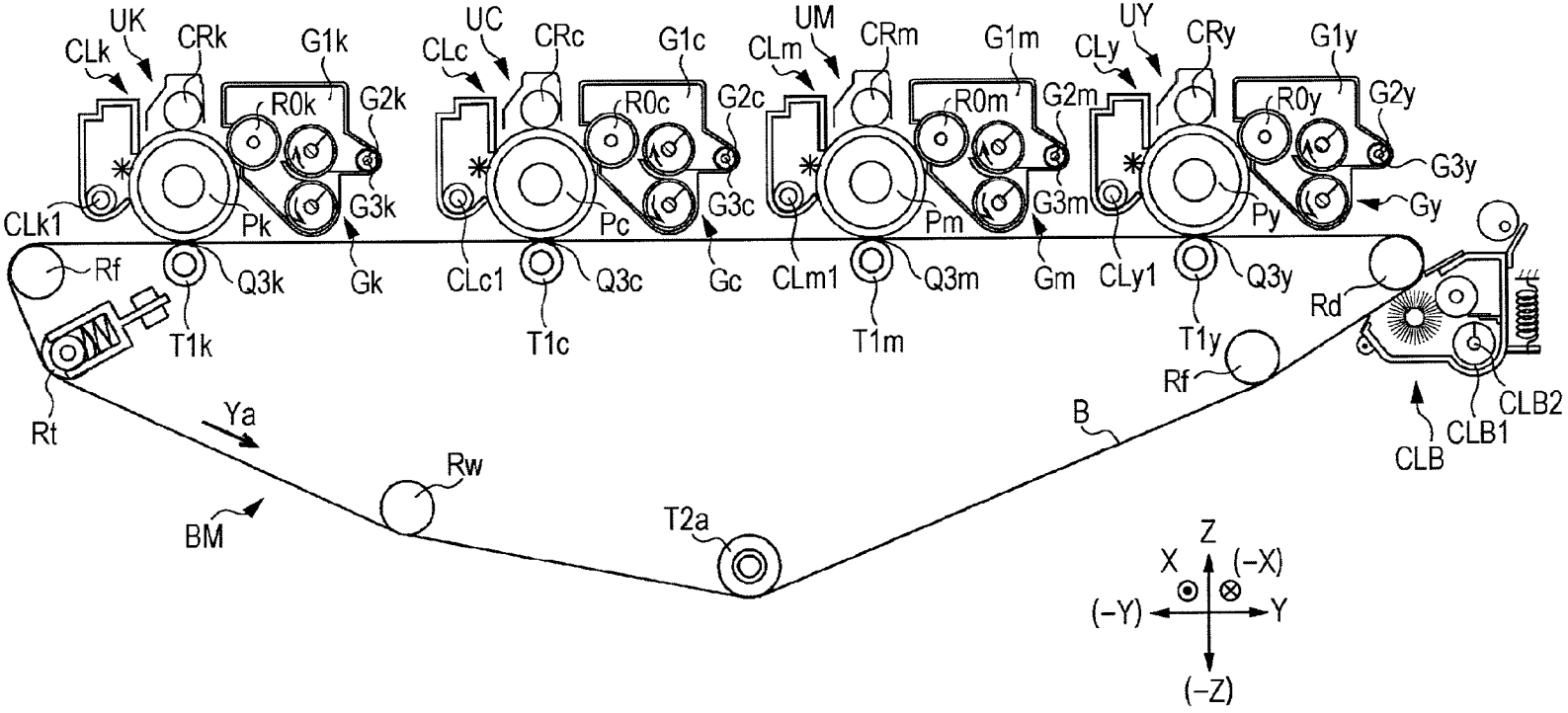
FIG. 2 is an enlarged view of a visible-image forming apparatus according to the first exemplary embodiment.

FIG. 2 is an enlarged view of a visible-image forming apparatus according to the first exemplary embodiment.

In FIG. 1, a copier U as an example of the image forming apparatus has an operable section UI, a scanner section U1 as an example of an image reading device, a feeder section U2 as an example of a medium feeding device, an image forming section U3 as an example of an image recording device, and a medium processing device U4.

Operable Section UI

The operable section UI has input buttons UIa used for starting copying and for setting the number of copy sheets. Moreover, the operable section UI has a display UIb that displays the contents input via the input buttons UIa as well as the status of the copier U.

Scanner Section U1

Figure 3:
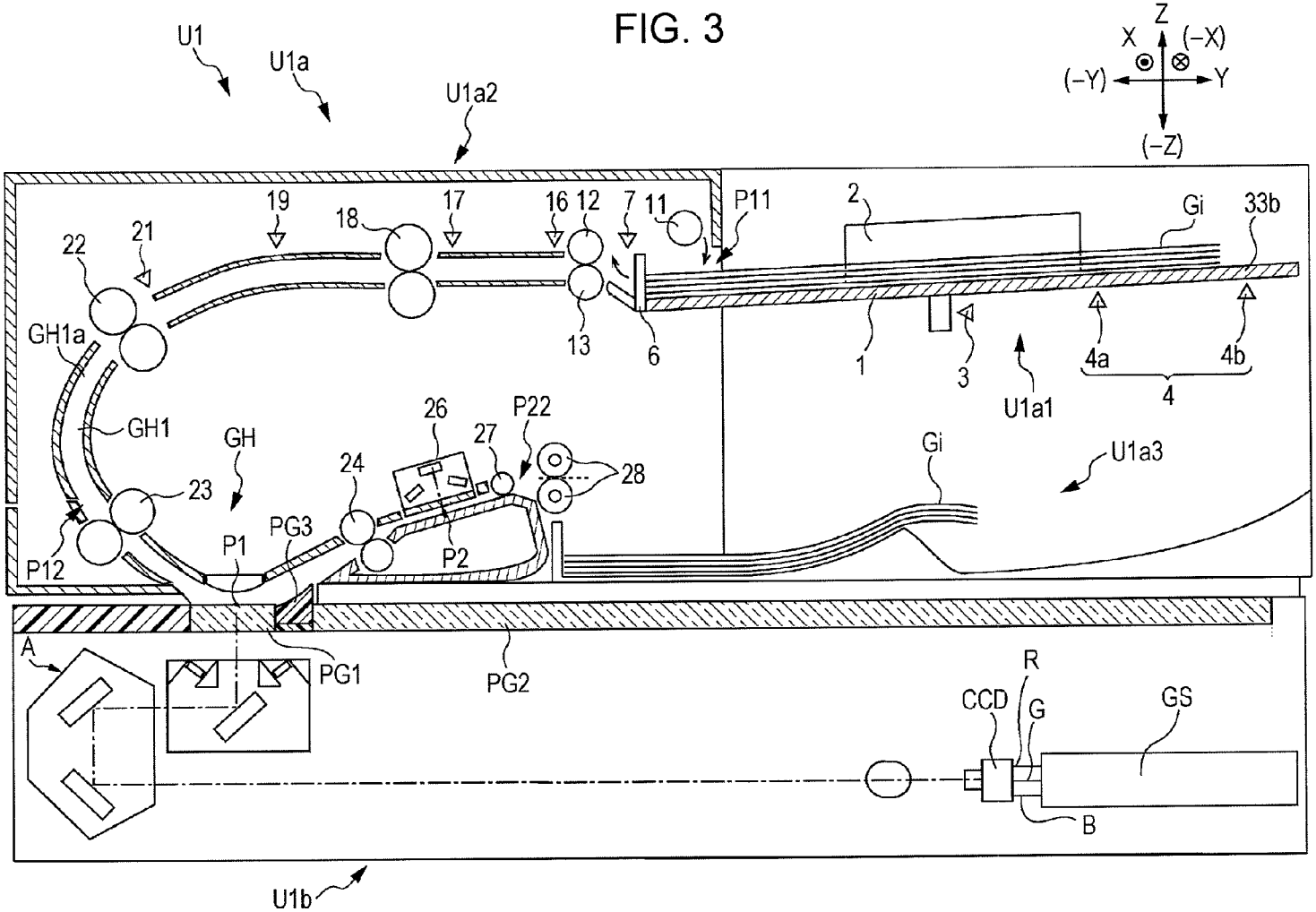
FIG. 3 is an overall view of an image reading device according to the first exemplary embodiment.

FIG. 3 is an overall view of the image reading device according to the first exemplary embodiment.

In FIGS. 1 and 3, the scanner section U1 has a scanner body U1*b* as an example of an image-reading-device body, which has a transparent document base PG at an upper end thereof. A document transport device U1*a* is disposed at the upper surface of the scanner body U1*b*. The document transport device U1*a* is supported in an openable-closable manner such that it is capable of uncovering and covering the document base PG.

The document transport device U1*a* has a document feed tray U1*a*1 as an example of a document load section that accommodates a stack of multiple documents Gi to be copied. A document transport section U1*a*2 is provided to the left of the document feed tray U1*a*1. The document transport section U1*a*2 transports the documents Gi on the document feed tray U1*a*1 onto the document base PG. A document output tray U1*a*3 as an example of a document output section is disposed below the document feed tray U1*a*1. Each document Gi that has traveled over the document base PG is output onto the document output tray U1*a*3 from the document transport section U1*a*2.

In FIG. 3, a read window PG1 as an example of a first read surface over which a document travels is disposed at the left end of the document base PG. The read window PG1 is formed in correspondence with a predetermined first-face read position P1 in a transport path of the document transport device U1*a*. Each document Gi transported by the document transport device U1*a* travels over the read window PG1. Platen glass PG2 that supports a document Gi set by a user is disposed to the right of the read window PG1. A document guide PG3 as an example of a guide is supported between the read window PG1 and the platen glass PG2. The document guide PG3 guides each document Gi that has traveled over the read window PG1 into the document transport device U1*a*.

An exposure optical system A is supported inside the scanner body U1*b*. Reflected light from the document Gi is converted into red (R), green (G), and blue (B) electric signals by a solid-state imaging element CCD as an example of a first reading member via multiple optical members of the exposure optical system A and is input to an image processor GS.

The image processor GS converts the R, G, and B electric signals input from the solid-state imaging element CCD into black (K), yellow (Y), magenta (M), and cyan (C) image information, temporarily stores the image information, and outputs the image information as latent-image-forming image information to a latent-image-forming-device drive circuit D of the image forming section U3 at a predetermined timing.

If a document image is a monochrome image, black (K) image information alone is input to the latent-image-forming-device drive circuit D.

The document base PG, the exposure optical system A, the solid-state imaging element CCD, and the image processor GS constitute the scanner body U1*b* according to the first exemplary embodiment.

Feeder Section U2

In FIG. 1, the feeder section U2 has feed trays TR1, TR2, TR3, and TR4 as an example of medium containers. Furthermore, the feeder section U2 has, for example, a medium feed path SH1 that fetches a recording sheet S as an example of a medium accommodated in each of the feed trays TR1 to TR4 and transports the recording sheet S to the image forming section U3.

Image Forming Section U3 and Medium Processing Device U4

Referring to FIGS. 1 and 2, in the image forming section U3, the latent-image-forming-device drive circuit D outputs a drive signal to latent-image forming devices ROSy to ROSk of the respective colors based on, for example, the image information input from the scanner section U1. For example, photoconductor drums Py to Pk as an example of image bearing members and charging rollers CRy to CRk are disposed below the latent-image forming devices ROSy to ROSk. Electrostatic latent images are formed on the surfaces of the photoconductor drums Py to Pk by the latent-image forming devices ROSy to ROSk and are developed into toner images as an example of visible images by developing devices Gy to Gk. The developing devices Gy to Gk are supplied with developers from toner cartridges Ky to Kk attached to a developer supplying device U3*b*. The toner images on the surfaces of the photoconductor drums Py to Pk are transferred onto an intermediate transfer belt B as an example of an intermediate transfer body in first-transfer regions Q3*y* to Q3*k* by first-transfer rollers T1*y* to T1*k*. After the first-transfer process, the photoconductor drums Py to Pk are cleaned by cleaners CLy to CLk.

An intermediate transfer device BM is supported below the latent-image forming devices ROSy to ROSk. The intermediate transfer device BM has the intermediate transfer belt B as an example of an intermediate transfer member and support members Rd+Rt+Rw+Rf+T2*a* for the intermediate transfer member. The intermediate transfer belt B is supported in a rotatable manner in a direction indicated by an arrow Ya. A second-transfer unit Ut is disposed below an opposing member T2*a*. The second-transfer unit Ut has a second-transfer member T2*b*. The second-transfer member T2*b* comes into contact with the intermediate transfer belt B so as to form a second-transfer region Q4. The opposing member T2*a* is in contact with an electric feed member T2*c*. The electric feed member T2*c* is supplied with second-transfer voltage with the same polarity as the charge polarity of toners.

A transport path SH2 along which the recording sheet S from the feeder section U2 is transported is disposed below the intermediate transfer device BM. In the transport path SH2, the recording sheet S is transported by a transport roller Ra as an example of a transport member to a registration roller Rr as an example of a transport-timing adjusting member. The registration roller Rr transports the recording sheet S to the second-transfer region Q4 in accordance with the timing at which the toner images on the intermediate transfer belt B are transported to the second-transfer region Q4.

When the toner images on the intermediate transfer belt B pass through the second-transfer region Q4, the toner images are transferred onto the recording sheet S by a second-transfer unit T2. After the second-transfer process, the intermediate transfer belt B is cleaned by an intermediate-transfer-body cleaner CLB. The recording sheet S having the toner images transferred thereon is transported to a medium transport belt BH as an example of a transport member and is then transported to a fixing device F. In the fixing device F, the recording sheet S having the toner images transferred thereon travels through a fixing region Q5 where a heating member Fh and a pressing member Fp come into contact with each other, so that the toner images become fixed onto the recording sheet S.

If the recording sheet S having the toner images fixed thereon is to be output, the recording sheet S is transported from a transport path SH3 to a transport path SH5 in the medium processing device U4. The medium processing device U4 has a curl correcting member U4*a* that corrects a curl in the recording sheet S, and also has an output member Rh by which the recording sheet S is output onto an output tray TH1. If an image is to be recorded onto the second face of the recording sheet S, the recording sheet S having the toner images fixed thereon is transported from the transport path SH3 to an inversion path SH4 and a circulation path SH6 so as to be turned over, and then travels along the medium feed path SH1 so as to be transported again to the second-transfer region Q4. The switching between the transport destinations is performed by switching members GT1 to GT3. A sheet transport path SH is constituted by components denoted by the reference characters SH1 to SH7. Furthermore, a sheet transport device SU according to the first exemplary embodiment is constituted by components denoted by the reference characters SH, Ra, Rr, Rh, SGr, SG1, SG2, BH, and GT1 to GT3.

Document Transport Device

Figure 4:
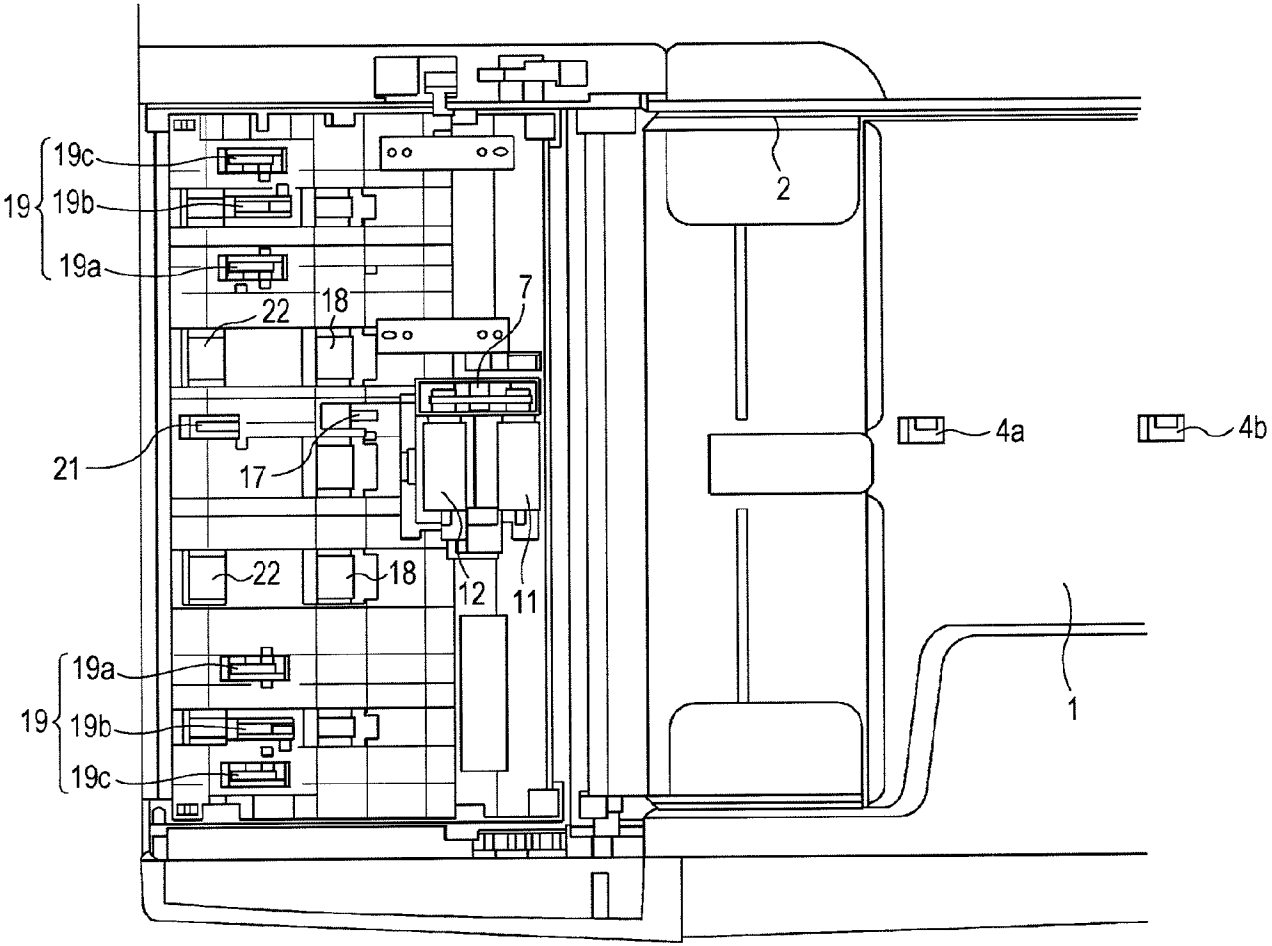
FIG. 4 illustrates the positional relationship of transport members and detecting members in a document transport device according to the first exemplary embodiment.

FIG. 4 illustrates the positional relationship of the transport members and detecting members in the document transport device U1*a* according to the first exemplary embodiment.

In FIGS. 3 and 4, the document feed tray U1*a*1 as an example of a document container has a feed tray body 1 as an example of a load member. The feed tray body 1 has a shape of a plate extending diagonally toward the upper right side.

A side guide 2 as an example of a medium alignment member is supported by a left portion of the feed tray body 1. The side guide 2 is supported in a movable manner in the front-rear direction, that is, the width direction of the documents Gi. The side guide 2 aligns the documents Gi by coming into contact with a widthwise edge of the documents Gi. Furthermore, the feed tray body 1 supports a tray-width sensor 3 as an example of a fourth detecting member. The tray-width sensor 3 detects the widthwise position of the side guide 2, that is, the width of the documents Gi.

The feed tray body 1 also supports a tray-size sensor 4 as an example of a detecting member. The tray-size sensor 4 according to the first exemplary embodiment includes a first tray-size sensor 4*a* disposed at the center in the left-right direction and a second tray-size sensor 4*b* disposed at the right side. The tray-size sensor 4 according to the first exemplary embodiment detects the presence or absence of a document Gi. Thus, when a document Gi is detected by both tray-size sensors 4*a* and 4*b*, it is determinable that the document Gi is a maximum-size document that is long in the transport direction thereof. If a document Gi is detected only by the first tray-size sensor 4*a*, it is determinable that the document Gi is a medium-size document. If a document Gi is not detected by either of the two tray-size sensors 4*a* and 4*b*, it is determinable that the document Gi is a small-size document.

A set gate 6 as an example of a medium alignment member is disposed at the left end of the document feed tray U1*a*1. The set gate 6 is supported in a rotatable manner. Before the documents Gi are transported, the set gate 6 is maintained in a hanging state such that the documents Gi are alignable by bringing the leading edge of the documents Gi in the transport direction into abutment with the set gate 6. When the transporting of the documents Gi commences, the set gate 6 is released and becomes rotatable toward the downstream side, so as not to interfere with the transporting of the documents Gi.

Furthermore, a set sensor 7 as an example of a detecting member is disposed at a position displaced from the set gate 6 in the front-rear direction. The set sensor 7 detects the presence or absence of a document or documents Gi abutting on the set gate 6.

A nudging roller 11 as an example of a document fetching member is disposed above the set gate 6 and upstream thereof in the document transport direction. The nudging roller 11 according to the first exemplary embodiment is configured to be ascendable and descendible.

A feed roller 12 as an example of a document transport member is disposed downstream of the set gate 6. A retardation roller 13 as an example of a document separating member is disposed below the feed roller 12 so as to face the feed roller 12.

A feed-in sensor 16 as an example of a detecting member is disposed downstream of the feed roller 12 and the retardation roller 13. The feed-in sensor 16 detects the presence or absence of a document Gi.

A feed-out sensor 17 as an example of a first detecting member is disposed downstream of the feed-in sensor 16. The feed-out sensor 17 detects the presence or absence of a document Gi.

A take-away roller 18 as an example of a document transport member and also as an example of a skew correcting member is disposed downstream of the feed-out sensor 17.

A document-width sensor 19 as an example of a second detecting member is disposed downstream of the take-away roller 18. In FIG. 4, the document-width sensor 19 according to the first exemplary embodiment includes multiple document-width sensors 19 spaced apart in the width direction of the document Gi. Specifically, the document-width sensors 19 include a pair of front and rear first document-width sensors 19*a* disposed at positions corresponding to a B5-size document Gi, a pair of front and rear second document-width sensors 19*b* disposed at positions corresponding to an A4-size document Gi, and a pair of front and rear third document-width sensors 19*c* disposed at positions corresponding to a B4-size document Gi.

A preregistration sensor 21 as an example of a third detecting member is disposed downstream of the document-width sensors 19. The preregistration sensor 21 detects the presence or absence of a document Gi.

A preregistration roller 22 as an example of a document transport member is disposed downstream of the preregistration sensor 21.

A document registration roller 23 as an example of a document transport member is disposed downstream of the preregistration roller 22. The document registration roller 23 adjusts the timing for transporting a document Gi toward a first-face read position P1.

An out roller 24 as an example of a document transport member is disposed downstream of the document registration roller 23 at a position downstream of the first-face read position P1.

A second-face read position P2 is set downstream of the out roller 24. A read sensor 26 as an example of a second reading member is disposed at the second-face read position P2. The read sensor 26 according to the first exemplary embodiment is a contact image sensor (CIS).

A reading roller 27 as an example of a reading assistance member is disposed downstream of the read sensor 26. An output roller 28 that outputs a document Gi onto the document output tray U1*a*3 is disposed downstream of the reading roller 27.

Functions of Scanner Body U1*b* and Document Transport Device U1*a*

When the scanner body U1*b* having the above-described configuration is to read an image from a document Gi placed on the platen glass PG2, the exposure optical system A scans the document Gi from the left edge to the right edge thereof. Reflected light from the document Gi is received by the solid-state imaging element CCD, so that the image of the document Gi is read.

When images of documents Gi transported by the document transport device U1*a* are to be read, the nudging roller 11 descends so as to come into contact with the uppermost surface of the documents Gi. Then, the nudging roller 11 rotates so as to feed the documents Gi. The documents Gi fed by the nudging roller 11 are separated one-by-one by the feed roller 12 and the retardation roller 13. Each separated document Gi is transported to the preregistration roller 22 by the take-away roller 18.

The document Gi transported by the preregistration roller 22 is transported to the first-face read position P1 by the document registration roller 23 in accordance with a predetermined timing. Reflected light from the document Gi passing the first-face read position P1 is received by the solid-state imaging element CCD, so that the image of the document Gi is read. The document Gi that has passed the first-face read position P1 is transported by the out roller 24 to the second-face read position P2. If both faces of the document Gi are to be read, the read sensor 26 reads an image of the second face, which is opposite the first face read by the solid-state imaging element CCD.

In the first exemplary embodiment, when an image is to be read by the read sensor 26, the reading roller 27 retains the document Gi so that the gap between the document Gi and the read sensor 26 may be readily made stable. The document Gi that has passed the second-face read position P2 is output to the document output tray U1*a*3 by the output roller 28.

Controller According to First Exemplary Embodiment

Figure 5:
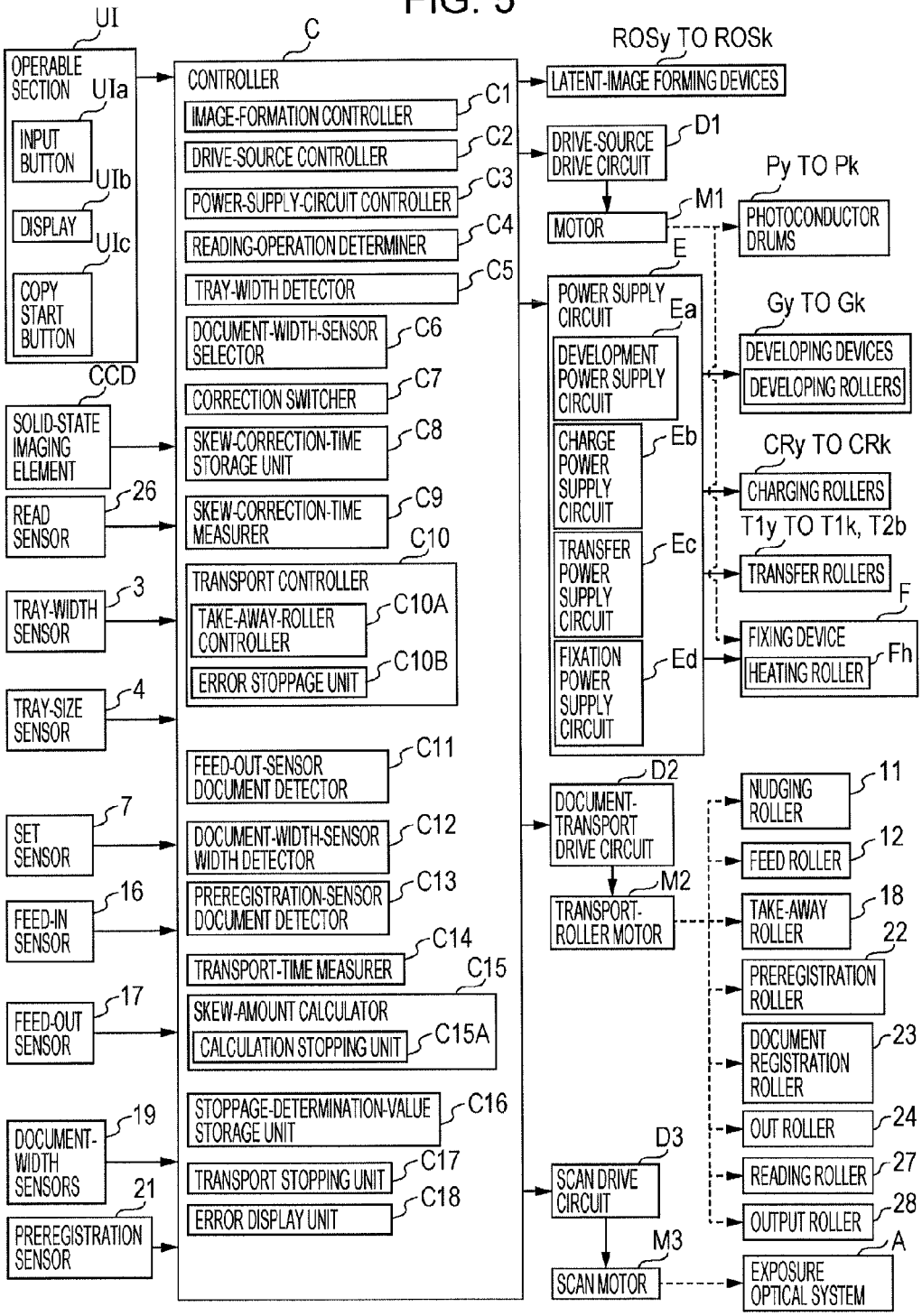
FIG. 5 is a block diagram illustrating functions included in a controller of the image forming apparatus according to the first exemplary embodiment.

FIG. 5 is a block diagram illustrating functions included in a controller of the image forming apparatus according to the first exemplary embodiment.

In FIG. 5, a controller C of the copier U has an input-output interface I/O used for receiving and outputting a signal from and to the outside. The controller C also has a read-only memory (ROM) that stores, for example, programs and information used for performing processes. Moreover, the controller C has a random access memory (RAM) that temporarily stores data. The controller C also has a central processing unit (CPU) that performs a process in accordance with a program stored in, for example, the ROM. Therefore, the controller C according to the first exemplary embodiment is constituted by a small-size information processing device, that is, a so-called microcomputer. Accordingly, the controller C is capable of realizing various functions by executing the programs stored in, for example, the ROM.

Signal Output Components Connected to Controller C

The controller C receives output signals from signal output components, such as the operable section UI, the solid-state imaging element CCD, the read sensor 26, and the sensors 3, 4, 7, 16, 17, 19, and 21.

The operable section UI includes the input buttons UIa, such as a button for inputting the number of print sheets and an arrow button, the display UIb as an example of a notifying member, and a copy start button UIc as an example of an input member for inputting start of a copying operation or a document reading operation.

The solid-state imaging element CCD reads a first-face image of a document Gi.

The read sensor 26 reads a second-face image of a document Gi passing the second-face read position P2.

The tray-width sensor 3 detects the width of a document Gi based on the widthwise position of the side guide 2.

The tray-size sensor 4 detects the length of a document Gi in the transport direction.

The set sensor 7 detects the presence or absence of a document Gi abutting on the set gate 6.

The feed-in sensor 16 detects the presence or absence of a document Gi in the vicinity of the feed roller 12.

The feed-out sensor 17 detects the presence or absence of a document Gi at the upstream side of the take-away roller 18.

The document-width sensors 19 detect the width of a document Gi.

The preregistration sensor 21 detects the presence or absence of a document Gi at the upstream side of the preregistration roller 22.

Controlled Components Connected to Controller C

The controller C is connected to a drive-source drive circuit D1, a document-transport drive circuit D2, a scan drive circuit D3, a power supply circuit E, and other controlled components (not shown). The controller C outputs control signals to, for example, the circuits D1 to D3 and E.

The drive-source drive circuit D1 rotationally drives, for example, the photoconductor drums Py to Pk as an example of image bearing members and the intermediate transfer belt B via a motor M1 as an example of a drive source.

The document-transport drive circuit D2 as an example of a document-transport-device drive circuit drives a transport-roller motor M2 as an example of a document-transport drive source so as to rotationally drive, for example, the nudging roller 11, the feed roller 12, and the take-away roller 18 disposed in the document transport path GH.

The scan drive circuit D3 drives a scan motor M3 as an example of a scan drive source so as to move the exposure optical system A in the left-right direction along the lower surface of the document base PG via, for example, a gear (not shown).

The power supply circuit E includes a development power supply circuit Ea, a charge power supply circuit Eb, a transfer power supply circuit Ec, and a fixation power supply circuit Ed.

The development power supply circuit Ea applies development voltage to developing rollers of the developing devices Gy to Gk.

The charge power supply circuit Eb applies charge voltage to the charging rollers CRy to CRk so as to electrostatically charge the surfaces of the photoconductor drums Py to Pk.

The transfer power supply circuit Ec applies transfer voltage to the second-transfer member T2*b* via the first-transfer rollers T1*y* to T1*k* and the electric feed member T2*c*.

The fixation power supply circuit Ed supplies electric power for heating the heating roller Fh of the fixing device F.

Functions of Controller C

The controller C has a function of executing processing according to input signals from the signal output components and outputting control signals to the controlled components. Specifically, the controller C has the following functions.

An image-formation controller C1 controls, for example, the driving of each component in the copier U and the voltage application timing in accordance with image information input from the solid-state imaging element CCD or the read sensor 26 of the scanner section U1 so as to execute a job, which is an image forming operation.

A drive-source controller C2 controls the driving of the motor M1 via the drive-source drive circuit D1 so as to control the driving of, for example, the photoconductor drums Py to Pk.

A power-supply-circuit controller C3 controls the power supply circuits Ea to Ed so as to control the voltage to be applied to each component and the electric power to be supplied to each component.

A reading-operation determiner C4 determines whether a reading operation to be executed when the copy start button UIc is input is an automatic reading operation or a manual reading operation based on a detection result of the set sensor 7. When the copy start button UIc is input, the reading-operation determiner C4 according to the first exemplary embodiment determines that the automatic reading operation is to be executed if the set sensor 7 detects a document Gi. Furthermore, when the copy start button UIc is input, the reading-operation determiner C4 according to the first exemplary embodiment determines that the manual reading operation is to be executed if the set sensor 7 does not detect a document Gi.

A tray-width detector C5 tentatively determines the width of a document Gi based on a detection result of the tray-width sensor 3.

Based on the width of the document Gi detected by the tray-width detector C5, a document-width-sensor selector C6 selects one of the pairs of document-width sensors 19*a* to 19*c* to be used when measuring a skew amount sk1. If the tray-width detector C5 determines that the size of the document Gi is B5 size or larger or smaller than A4 size, the document-width-sensor selector C6 according to the first exemplary embodiment selects the first document-width sensors 19*a*. If the tray-width detector C5 determines that the size of the document Gi is A4 size or larger or smaller than B4 size, the document-width-sensor selector C6 according to the first exemplary embodiment selects the second document-width sensors 19*b*. If the tray-width detector C5 determines that the size of the document Gi is B4 size or larger, the document-width-sensor selector C6 according to the first exemplary embodiment selects the third document-width sensors 19*c*.

If the tray-width detector C5 determines that the size of the document Gi is smaller than B5 size, the document-width-sensor selector C6 according to the first exemplary embodiment does not select the sensors. In other words, since the skew amount sk1 is not measurable, it is determined that the skew amount sk1 is not to be measured.

In the first exemplary embodiment, one of the pairs of document-width sensors 19*a* to 19*c* is selected when the size of the document Gi is B5 size or larger. Alternatively, for example, the first document-width sensors 19*a* may be constantly used so long as the size of the document Gi is B5 size or larger.

A correction switcher C7 performs switching in accordance with whether or not skew correction is to be executed at the take-away roller 18. When a copying operation is to be executed, the correction switcher C7 according to the first exemplary embodiment performs switching to a so-called registration-less operation in which a document is transported without being abutted on the take-away roller 18. When a so-called scan mode in which a document is simply read is to be executed or when a facsimile transmission operation is to be executed, the correction switcher C7 according to the first exemplary embodiment performs switching to a so-called registration operation in which skew correction is performed by bringing a document into abutment with the take-away roller 18. In the first exemplary embodiment, the switching for executing or not executing skew correction is automatically performed based on an operation to be executed. Alternatively, for example, the switching may be performed in accordance with user settings, the registration operation may be performed when a document Gi is to be read at high speed, or the registration-less operation may be performed when a document Gi is to be read at normal speed.

When skew correction is to be executed at the take-away roller 18, a skew-correction-time storage unit C8 stores a time period t1 in which the skew correction is performed by bringing a document Gi into abutment with the take-away roller 18. The time period t1 stored in the skew-correction-time storage unit C8 according to the first exemplary embodiment extends from when the feed-out sensor 17 detects a document to when the skew correction ends.

A skew-correction-time measurer C9 measures the skew-correction time period t1. When the feed-out sensor 17 detects a document, the skew-correction-time measurer C9 according to the first exemplary embodiment starts measuring the skew-correction time period t1.

A transport controller C10 includes a take-away-roller controller C10A and an error stoppage unit C10B and controls the driving of, for example, the nudging roller 11 and the feed roller 12 via the document-transport drive circuit D2. When a job commences in the registration-less mode, the transport controller C10 according to the first exemplary embodiment drives the nudging roller 11 to the preregistration roller 22 so as to transport a document Gi to the document registration roller 23, subsequently stops the document Gi, and then drives the rollers 24 to 28 located downstream of the document registration roller 23 at a predetermined timing by using the document registration roller 23. In a case of the registration mode, the transport controller C10 according to the first exemplary embodiment drives the nudging roller 11 and the feed roller 12 and stops the take-away roller 18 so as to bring the document Gi into abutment with the take-away roller 18. Then, the transport controller C10 according to the first exemplary embodiment transports the document Gi to the document registration roller 23 by driving the take-away roller 18 and the preregistration roller 22. The subsequent process is the same as that in the registration-less mode.

The take-away-roller controller C10A controls the driving of the take-away roller 18. In a case of the registration-less mode, the take-away-roller controller C10A according to the first exemplary embodiment starts driving the take-away roller 18 when a job commences. In a case of the registration mode, the take-away-roller controller C10A according to the first exemplary embodiment does not drive the take-away roller 18 when a job commences, but drives the take-away roller 18 when the skew-correction-time measurer C9 finishes measuring the skew-correction time period t1.

When a document Gi is jammed or when the skew amount sk1 is larger than or equal to a stoppage determination value ska to be described later, the error stoppage unit C10B determines that the document Gi is not readable and stops the driving of the rollers 11 to 28.

A feed-out-sensor document detector C11 detects whether or not a document Gi has passed the position of the feed-out sensor 17 based on a detection signal of the feed-out sensor 17.

A document-width-sensor width detector C12 detects the width of a document Gi based on a detection signal of the document-width sensors 19. The document-width-sensor width detector C12 according to the first exemplary embodiment detects the width of a document Gi based on the distance between the outermost sensors among the document-width sensors 19*a* to 19*c* that have detected the document Gi.

A preregistration-sensor document detector C13 detects whether or not a document Gi has passed the position of the preregistration sensor 21 based on a detection signal of the preregistration sensor 21.

A transport-time measurer C14 measures a transport time period t2 or t2' of a document Gi. In a case of the registration mode, the transport-time measurer C14 according to the first exemplary embodiment measures the transport time period t2 from when the driving of the take-away roller 18 starts to when the document Gi is detected by one of the pairs of document-width sensors 19*a* to 19*c* selected by the document-width-sensor selector C6. In a case of the registration-less mode, the transport-time measurer C14 according to the first exemplary embodiment measures the transport time period t2' from when the feed-out sensor 17 detects a document Gi to when the document Gi is detected by one of the pairs of document-width sensors 19*a* to 19*c* selected by the document-width-sensor selector C6.

Figure 6:
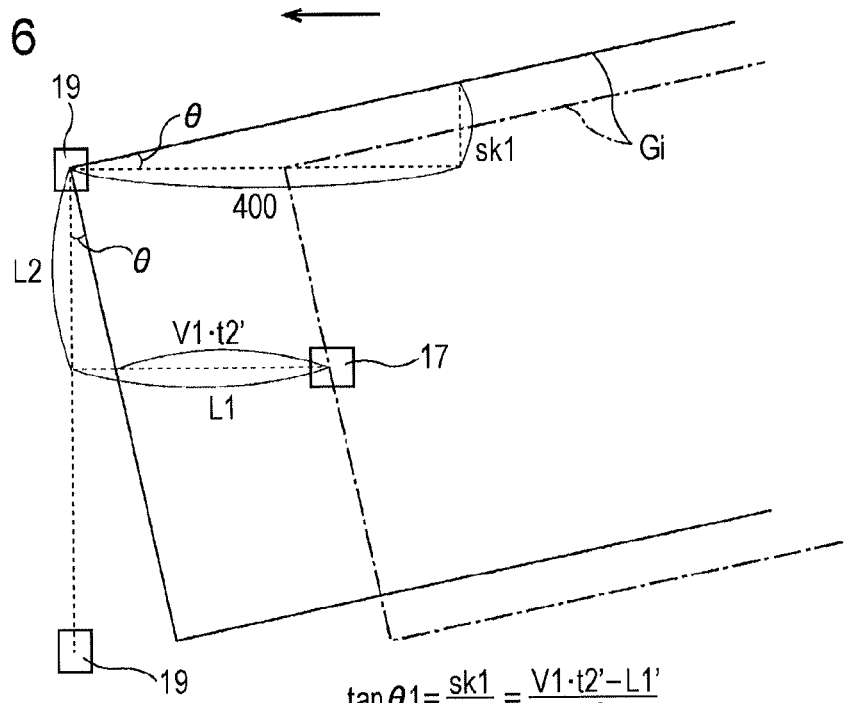
FIG. 6 illustrates a method of how a skew amount is calculated in a registration-less mode in accordance with the first exemplary embodiment.

FIG. 6 illustrates a method of how the skew amount sk1 is calculated in the registration-less mode in accordance with the first exemplary embodiment.

A skew-amount calculator C15 as an example of a skew-amount measurer has a calculation stopping unit C15A and calculates the skew amount sk1 as an example of a skew amount of a document Gi. When in the registration mode, the skew-amount calculator C15 according to the first exemplary embodiment calculates the skew amount sk1 based on the transport time period t2, a distance L1 from the take-away roller 18 to one of the pairs of document-width sensors 19*a* to 19*c* in the document transport direction, and a distance L2 from the center of one of the pairs of document-width sensors 19*a* to 19*c* in the document width direction. When in the registration-less mode, the skew-amount calculator C15 according to the first exemplary embodiment calculates the skew amount sk1 based on the transport time period t2', a distance L1' from the feed-out sensor 17 to one of the pairs of document-width sensors 19*a* to 19*c* in the document transport direction, and the distance L2 from the center of one of the pairs of document-width sensors 19*a* to 19*c* in the document width direction.

Specifically, referring to FIG. 6, in a case where the transport speed of the document Gi is defined as V1 and the skew amount sk1 is displacement in the document width direction relative to 400 mm in the document transport direction, the skew amount sk1 is calculated based on the following expression (1) in the registration mode, and the skew amount sk1 is calculated based on the following expression (1') in the registration-less mode.

$$sk1=(V1\cdot t2-L1)\cdot(400/L2) \quad (1)$$

$$sk1=(V1\cdot t2'-L1')\cdot(400/L2) \quad (1')$$

Although FIG. 6 corresponds to the registration-less mode, a diagram corresponding to the registration mode is similar thereto in that the feed-out sensor 17 is simply replaced with the take-away roller 18. Therefore, a diagram corresponding to the registration mode will be omitted here.

The calculation stopping unit C15A stops the calculation of the skew amount sk1 if it is not possible to calculate the skew amount sk1. If the preregistration sensor 21 detects a document before the document-width sensors 19 detects a document Gi, the calculation stopping unit C15A according to the first exemplary embodiment determines that it is not possible to calculate the skew amount sk1 since the skew amount is too large, and thus does not perform the calculation of the skew amount sk1. If the document Gi is too small based on detection of the tray-width detector C5 and the document-width-sensor selector C6 does not select any of the document-width sensors 19*a* to 19*c*, the calculation stopping unit C15A determines that it is not possible to calculate the skew amount sk1, and thus does not perform the calculation of the skew amount sk1.

Figure 7:
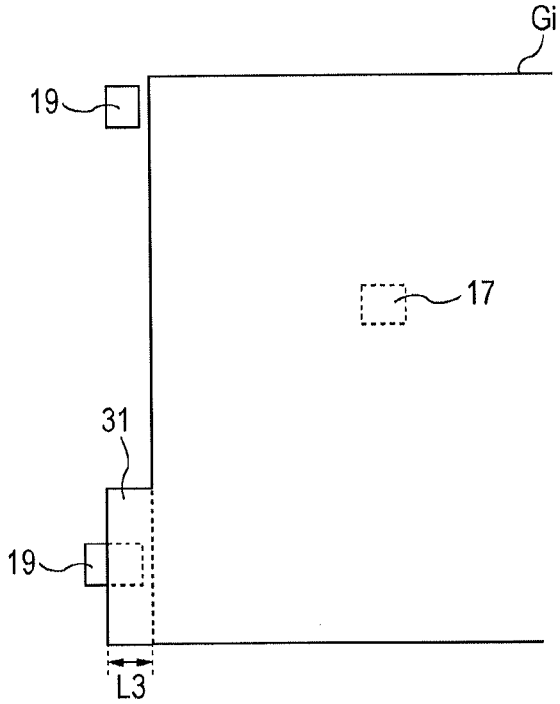
FIG. 7 illustrates a reading operation for reading an indexed document.

FIG. 7 illustrates a reading operation for reading an indexed document.

A stoppage-determination-value storage unit C16 stores the stoppage determination value ska as an example of a preset skew amount. The stoppage determination value ska is used for determining whether or not the skew amount sk1 is too large. The stoppage determination value ska according to the first exemplary embodiment is set to a value larger than a skew amount sk1 equivalent to a size L3 of an index portion 31 formed at an edge of an indexed document Gi, that is, an indexed sheet. Specifically, the stoppage determination value ska is set such that, when an indexed sheet is to be read, if the index portion 31 protruding from the edge thereof is detected, the transporting of the document Gi is not stopped. With regard to commercially-available indexed sheets, the size L3 of the index portion 31 is often set to 12 mm.

If the skew amount sk1 calculated by the skew-amount calculator C15 exceeds the stoppage determination value ska, a transport stopping unit C17 stops the driving of the rollers 11 to 28 so as to stop the transporting of the document Gi. Furthermore, the transport stopping unit C17 according to the first exemplary embodiment also stops the transporting of the document Gi if the calculation of the skew amount sk1 is stopped by the calculation stopping unit C15A.

If the transporting of the document Gi is stopped, an error display unit C18 causes the display UIb to display an error message indicating that the transporting of the document Gi has been stopped.

Flowchart According to First Exemplary Embodiment

Next, the flow of control performed in the copier U according to the first exemplary embodiment will be described with reference to a flowchart.

Flowchart of Document Transport Control Process According to Skew Amount

Figure 8:
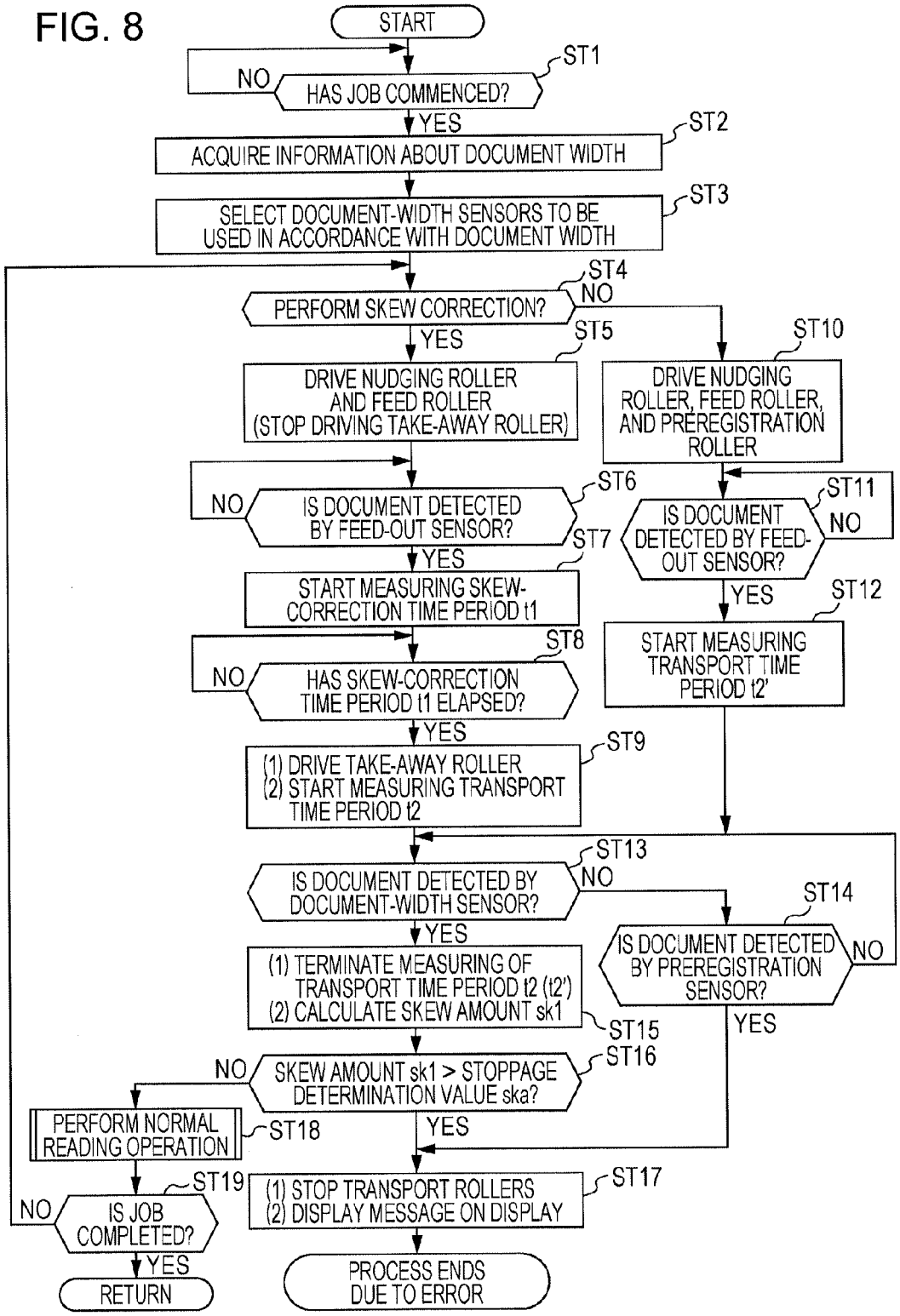
FIG. 8 is a flowchart of a document transport control process according to the first exemplary embodiment.

FIG. 8 is a flowchart of a document transport control process according to the first exemplary embodiment.

Steps ST in the flowchart in FIG. 8 are performed in accordance with a program stored in the controller C of the copier U. Furthermore, this process is executed concurrently with other various processes in the copier U.

The flowchart shown in FIG. 8 starts when the power of the copier U is turned on.

In step ST1 in FIG. 8, it is determined whether or not a job, such as a copying operation, a scanning operation, or a facsimile transmission operation, has commenced. If yes (Y), the process proceeds to step ST2. If not (N), step ST1 is repeated.

In step ST2, the width of a document Gi is acquired based on a detection signal of the tray-width sensor 3. Then, the process proceeds to step ST3.

In step ST3, one of the pairs of document-width sensors 19*a* to 19*c* to be used is selected in accordance with the acquired document width. Then, the process proceeds to step ST4.

In step ST4, it is determined whether or not skew correction, that is, a registration mode or a registration-less mode, is to be performed in accordance with the operation, such as a copying operation or a scanning operation. If yes (Y), that is, in a case of the registration mode, the process proceeds to step ST5. If not (N), that is, in a case of the registration-less mode, the process proceeds to step ST10.

In step ST5, the nudging roller 11 and the feed roller 12 are driven. In other words, the driving of the take-away roller 18 is stopped. Then, the process proceeds to step ST6.

In step ST6, it is determined whether or not the document Gi is detected by the feed-out sensor 17. If yes (Y), the process proceeds to step ST7. If not (N), step ST6 is repeated.

In step ST7, a timekeeping step for measuring the skew-correction time period t1 starts. Then, the process proceeds to step ST8.

In step ST8, it is determined whether or not the skew-correction time period t1 has elapsed. If yes (Y), the process proceeds to step ST9. If not (N), step ST8 is repeated.

In step ST9, the following steps (1) and (2) are executed. Then, the process proceeds to step ST13.

(1) The take-away roller 18 is driven.

(2) A timekeeping step for measuring the transport time period t2 starts.

In step ST10, the nudging roller 11 to the preregistration roller 22 are driven. Then, the process proceeds to step ST11.

In step ST11, it is determined whether or not the document Gi is detected by the feed-out sensor 17. If yes (Y), the process proceeds to step ST12. If not (N), step ST11 is repeated.

In step ST12, a timekeeping step for measuring the transport time period t2' starts. Then, the process proceeds to step ST13.

In step ST13, it is determined whether or not the document Gi is detected by any one of the pairs of document-width sensors 19*a* to 19*c*. If not (N), the process proceeds to step ST14. If yes (Y), the process proceeds to step ST15.

In step ST14, it is determined whether or not the document Gi is detected by the preregistration sensor 21. If not (N), the process returns to step ST13. If yes (Y), the process proceeds to step ST17.

In step ST15, the following steps (1) and (2) are executed. Then, the process proceeds to step ST16.

(1) The timekeeping step for measuring the transport time period t2 or t2' ends.

(2) The skew amount sk1 is calculated based on expression (1) or (1').

In step ST16, it is determined whether or not the skew amount sk1 is larger than the stoppage determination value ska. If yes (Y), the process proceeds to step ST17. If not (N), the process proceeds to step ST18.

In step ST17, the following steps (1) and (2) are executed, and the process ends due to an error.

(1) All of the transport rollers 11 to 28 are stopped.

(2) An error message is displayed on the display UIb.

In step ST18, a normal reading operation is performed, that is, the document Gi is transported from the document registration roller 23 in accordance with a predetermined timing and is read by the solid-state imaging element CCD or the read sensor 26. Then, the process proceeds to step ST19.

In step ST19, it is determined whether or not the job is completed. If not (N), the process returns to step ST4. If yes (Y), the process returns to step ST1.

Specific Functions of Scanner Body U1*b* and Document Transport Device U1*a*

In the copier U according to the first exemplary embodiment having the above-described configuration, when the copy start button UIc is input in a state where documents Gi are stacked on the document feed tray U1*a*1, the automatic reading operation is executed. Specifically, each of the documents Gi stacked on the document feed tray U1*a*1 is fed and transported to the document transport path GH. With regard to each document Gi transported along the document transport path GH, the first face and the second face of the document Gi are read by the solid-state imaging element CCD or the read sensor 26 at the read position P1 or P2.

In the first exemplary embodiment, the skew amount sk1 is measured, and if the skew amount sk1 is larger than the stoppage determination value ska, the transporting of the document Gi is stopped.

In the technology discussed in Japanese Unexamined Patent Application Publication No. 2008-050132, a skew amount is measured by a document-width sensor and a reading entrance sensor located downstream thereof. This is equivalent to a configuration in which the measurement is performed between the document-width sensors 19 and the preregistration sensor 21 in the first exemplary embodiment. In this configuration, if the skew amount of a document is too large, the document is stopped at a position near a document registration roller. This is problematic in that the process for removing the stopped document tends to be a troublesome task.

In the technology discussed in Japanese Unexamined Patent Application Publication No. 2005-263396, a skew amount is measured by using multiple document-width sensors spaced apart from each other in the width direction. However, in this configuration, a document has to pass by multiple sensors. Thus, if the document has a small size and passes by only one sensor in the width direction or if the skew amount is large and it takes time for the document to pass by multiple sensors, it may be not possible to measure the skew amount or the document may be stopped at a downstream position, possibly resulting in a troublesome document removal process.

In contrast, in the first exemplary embodiment, the skew amount sk1 is measured with reference to the feed-out sensor 17 or the take-away roller 18 located upstream of the document-width sensors 19. Thus, if the skew amount sk1 is large, the document is stopped at a position located further upstream than in Japanese Unexamined Patent Application Publication No. 2008-050132.

For example, in a case where multiple documents held together with a staple, a clip, or the like are accidentally transported, the documents may become jammed in a downstream transport path while being skewed by a large amount. In this case, when the documents are being removed, the documents may tear or a torn piece thereof may remain in the transport path. Such a remaining torn piece may cause a subsequent document to become jammed. Moreover, if the torn piece reaches the read position P1 or P2, the torn piece may appear in the read image, possibly resulting in a read error. Therefore, in this exemplary embodiment of the present invention, the document Gi is stopped upstream as much as possible so as to reduce damage to the document Gi, such as the document Gi becoming torn or folded.

Furthermore, in the first exemplary embodiment, if the skew amount of a document Gi increases as the document Gi is detected by the preregistration sensor 21 in a state where the document Gi is not detected by the document-width sensors 19, the transporting of the document Gi is stopped without calculating the skew amount sk1. Thus, damage to the document Gi may be reduced.

Furthermore, in the first exemplary embodiment, when it is detected that a document has passed the document-width sensors 19 as well as the feed-out sensor 17 and the take-away roller 18 located upstream of the document-width sensors 19, the skew amount sk1 is measured. In a case where the skew amount is to be measured only at the position of the document-width sensors 19, as in Japanese Unexamined Patent Application Publication No. 2005-263396, it may be not possible to perform the measurement depending on the document size or skew amount. In contrast, in the case where the measurement positions are separately provided at the upstream side and the downstream side in the transport direction, as in the first exemplary embodiment, the measurement may be performed based on a comparison with the positions of the upstream members 17 and 18 even if the document size or the skew amount is large.

Furthermore, in the first exemplary embodiment, a condition, that is, a trigger, for starting the measurement of the transport time period t2 or t2' is changed in accordance with whether or not skew correction is to be performed. Assuming that the feed-out sensor 17 is used when performing skew correction, the skew correction is performed in a period from when the feed-out sensor 17 detects a document to when the document-width sensors 19 detect the document. Therefore, the document Gi is temporarily stopped within the transport time period, which tends to cause the transport time period to include an error. In contrast, when performing skew correction in the first exemplary embodiment, the start of driving of the take-away roller 18 is set as the trigger. Therefore, as compared with the case where the trigger is not changed regardless of whether or not skew correction is to be performed, the skew amount sk1 is detectable more accurately in the first exemplary embodiment, so that the document Gi may be stopped more accurately based on the skew amount sk1.

Furthermore, in the first exemplary embodiment, a value that corresponds to an indexed sheet is set as the stoppage determination value ska. Thus, even when an indexed sheet is used as the document Gi, the document Gi is still readable. Although a value that corresponds to an indexed sheet is set as the stoppage determination value ska in the first exemplary embodiment, for example, the stoppage determination value ska corresponding to an indexed sheet may be used when an indexed sheet is selected based on an input from the operable section UI, and a stoppage determination value for a document Gi without the index portion 31 may be used when an indexed sheet is not selected.

Furthermore, in the first exemplary embodiment, one of outer pairs of document-width sensors 19*a* to 19*c* is selected from among the document-width sensors 19*a* to 19*c* based on a detection result of the tray-width sensor 3. In FIG. 6, when the document Gi is skewed, the sensors located within the width of the document Gi tend to detect the document Gi slower than the outer sensors. Therefore, in the first exemplary embodiment, the skewed document Gi is detectable quickly by using one of outer pairs of document-width sensors 19*a* to 19*c*. Consequently, the skew amount sk1 may be measured quickly, and the document Gi may be stopped further upstream.

Modifications

Although the exemplary embodiment of the present invention has been described in detail above, the present invention is not to be limited to the above exemplary embodiment and permits various modifications within the technical scope of the invention defined in the claims. Modifications H01 to H08 will be described below.

In a first modification H01, the image forming apparatus according to the above exemplary embodiment is not limited to the copier U, and may be, for example, a facsimile apparatus or a multifunction apparatus having multiple functions of such apparatuses. Furthermore, the above exemplary embodiment is not limited to an electrophotographic image forming apparatus and may be applied to an image forming apparatus of an arbitrary image forming type, such as a lithographic printer of an inkjet recording type or a thermal head type. Moreover, the above exemplary embodiment is not limited to a multicolor image forming apparatus and may be applied to a so-called monochrome image forming apparatus. The above exemplary embodiment is not limited to a so-called tandem-type image forming apparatus and may be applied to, for example, a rotary-type image forming apparatus.

The above exemplary embodiment is applied to the copier U having the scanner section U1 as an example of an image reading device. Alternatively, in a second modification H02, the above exemplary embodiment may be applied to the scanner section U1 alone.

The above exemplary embodiment is applied to the scanner section U1 that is capable of executing the automatic reading operation and the manual reading operation. Alternatively, for example, in a third modification H03, a configuration in which only the automatic reading operation is executable and the manual reading operation is omitted is possible.

In the above exemplary embodiment, the document transport device U1*a* desirably uses the reading members CCD and 26 to read images of documents Gi at the two read positions P1 and P2. Alternatively, for example, a fourth modification H04 may provide a configuration in which the read sensor 26 is omitted and a document-inverting transport path is provided such that an image of the document Gi is read only at the read position P1, or a configuration that reads only one face of the document Gi.

In the above exemplary embodiment, skew correction is performed at the take-away roller 18. Alternatively, for example, in a fifth modification H05, skew correction may be performed by bringing a document Gi into abutment with the document registration roller 23. In this case, the feed-out sensor 17 may act as the trigger in both the registration mode and the registration-less mode.

In the above exemplary embodiment, one of the pairs of document-width sensors 19*a* to 19*c* is selected based on the tray-width sensor 3. Alternatively, for example, a sixth modification H06 may provide a configuration that does not use the detection signal of the tray-width sensor 3 by constantly using the innermost first document-width sensors 19*a* for measuring the skew amount.

In the above exemplary embodiment, when the preregistration sensor 21 detects a document in a state where the document is not detected by the document-width sensors 19, the transporting of the document is desirably stopped. Alternatively, a seventh modification H07 may provide a configuration that does not use the preregistration sensor 21.

In the above exemplary embodiment, the transport time period t2 or t2' is measured when measuring the skew amount sk1. Alternatively, in an eighth modification H08, instead of directly measuring the time period, the time period may be indirectly measured by using an arbitrary time-related parameter, such as the rotational amount of a motor or the number of pulses if a pulse motor is used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image reading device comprising:

a container that accommodates a document;

a transport path along which the document from the container is transported;

a reading member that reads an image of the document passing a predetermined read position in the transport path;

a skew correcting member that is disposed upstream of the read position in a transport direction of the document, transports the document downstream, and corrects a skew of the document when the document is brought into abutment with the skew correcting member;

a first detecting member that is disposed upstream of the skew correcting member and downstream of the container in the transport direction of the document and that detects the document;

a second detecting member that is disposed downstream of the skew correcting member and upstream of the read position in the transport direction of the document and that detects the document;

a correction switcher that performs switching in accordance with whether or not skew correction is to be executed at the skew correcting member;

a skew-amount measurer that measures a skew amount of the document based on a time period from when the skew correcting member starts to rotate to when the second detecting member detects the document if the skew of the document is to be corrected, and that measures the skew amount of the document based on a time period from when the first detecting member detects the document to when the second detecting member detects the document if the skew of the document is not to be corrected; and a transport stopping unit that stops transporting of the document if the skew amount of the document exceeds a predetermined skew amount.

2. The image reading device according to claim 1, wherein the predetermined skew amount for an indexed document having an index portion supported by an edge of a medium is set to a value larger than a size of the index portion.

3. The image reading device according to claim 1, further comprising:

a third detecting member that is disposed downstream of the second detecting member in the transport direction of the document and that detects the document, wherein the skew-amount measurer stops measuring the skew amount of the document if the second detecting member does not detect the document and if the third detecting member detects the document.

4. The image reading device according to claim 1, further comprising:

a fourth detecting member that is provided in the container and that detects a size of the document, wherein the skew-amount measurer stops measuring the skew amount of the document if the size of the document detected by the fourth detecting member is smaller than or equal to a predetermined size.

5. The image reading device according to claim 1, wherein the second detecting member includes a plurality of second detecting members that are spaced apart in a width direction of the document and that detect a size of the document, wherein the image reading device further comprises:

a fourth detecting member that is provided in the container and that detects the size of the document; and a selector that selects one of the second detecting members to be used when measuring the skew amount of the document in accordance with the size of the document detected by the fourth detecting member.

6. An image forming apparatus comprising:

the image reading device according to claim 1; and an image recording device that records an image onto a medium based on an image read by the image reading device.

* * * * *